United States Patent [19]

Chadshay

[11] Patent Number: 4,602,571

[45] Date of Patent: Jul. 29, 1986

[54] BURNER FOR COAL SLURRY

[75] Inventor: Roman Chadshay, Windsor, Conn.

[73] Assignee: Combustion Engineering, Inc., Windsor, Conn.

[21] Appl. No.: 635,785

[22] Filed: Jul. 30, 1984

[51] Int. Cl.[4] ..... F23D 1/02

[52] U.S. Cl. ..... 110/264; 110/265; 431/182; 431/186; 431/188; 239/400; 239/417; 239/422

[58] Field of Search ..... 431/181, 182, 183, 186, 431/187, 188, 189, 184; 110/261, 263, 264, 265, 347; 239/400, 401, 403, 416, 416.5, 417, 422, 423

[56] References Cited

U.S. PATENT DOCUMENTS

| | | | |
|---|---|---|---|
| 2,269,333 | 1/1942 | Bloom | 431/188 |
| 2,359,049 | 9/1944 | Nagel | 431/188 |
| 3,124,086 | 3/1964 | Sage et al. | 110/264 |
| 3,743,471 | 7/1973 | Jaeger | 431/188 X |
| 4,333,405 | 6/1982 | Michelfelder et al. | 431/184 |
| 4,519,322 | 5/1985 | Lindstrom et al. | 110/264 |

FOREIGN PATENT DOCUMENTS

| | | | |
|---|---|---|---|
| 1963916 | 6/1971 | Fed. Rep. of Germany | 431/187 |
| 2724532 | 12/1978 | Fed. Rep. of Germany | 431/183 |
| 1016773 | 11/1952 | France | 431/188 |

*Primary Examiner*—Margaret A. Focarino

*Attorney, Agent, or Firm*—William W. Habelt

[57] ABSTRACT

A burner (10) is provided for supplying coal-liquid slurry and combustion air to a furnace (2). The burner housing (12) is mounted about the burner throat opening (6) and interconnected to a combustion air supply duct (8). A coal slurry gun (14) is disposed coaxially within the housing for spraying the coal-liquid slurry into the furnace. A first conduit means (20) is disposed coaxially about the coal slurry gun to define a primary air flow passage (22) surrounding the slurry gun. Additionally, a second conduit means (30) is disposed coaxially about the first conduit means (20) to define a secondary air flow passage (32) between the first and second conduit means and a tertiary air flow passage (34) between the second conduit means and the burner throat (4). Independently controllable dampers 41, 42 and 43 are provided in the air inlets to the primary, secondary and tertiary air flow passages to permit independent control of air flow velocity. A diffuser means (50) is slidably mounted about the coal slurry gun so as to be translatable from a position adjacent the furnace at low loads to a position remote therefrom at high loads. Further, an annular sleeve (60) is mounted about the first conduit means (20) and translatable therealong for selective postioning relative to the diffuser means (50) for controlling the flow area (33) of the outlet of the secondary air flow passage (32).

3 Claims, 3 Drawing Figures

BURNER FOR COAL SLURRY

BACKGROUND OF THE INVENTION

The present invention relates to a burner for supplying liquid fuel and air to a furnace and, more particularly, to a burner for supplying coal slurry fuel and air to a furnace.

One type of burner commonly utilized on industrial and certain utility furnaces firing liquid fuel, such as oil, is known as a round burner. In such a burner, a fuel supply pipe is disposed coaxially within an outer air supply conduit which comprises the outer housing of the burner. The fuel supply pipe opens into the furnace for spraying the liquid fuel into the furnace. One or more annular flow passages are defined coaxially about the fuel supply plate through which combustion air is passed into the furnace so as to annularly surround the liquid fuel sprayed into the furnace. One particular embodiment of this type of burner is disclosed is U.S. Pat. No. 3,743,471.

In recent years, interest has generated in the utilization of coal as a replacement fuel for more costly and less available fuel oil. One scenario for using coal as a replacement fuel for oil comprises burning the coal as a liquid by forming a mixture of coal and water which has the properties of a liquid slurry. However, experience has shown that coal-water mixtures, although liquid slurries, cannot be directly substituted for fuel oil on typical industrial and utility furnaces. Combustion characteristics of coal-water mixtures are not the same as the combustion characteristics of typical fuel oil. Additionally, the combustion characteristics of a coal-water mixture depend directly upon the coal being utilized in the mixture. Therefore, as coals vary substantially in their combustion characteristics, the burning equipment utilized on a furnace firing coal-water slurry must be capable of handling liquid fuels having a wide range of combustion characteristics as one cannot be assured of always having available a coal-water slurry made from a particular coal.

Accordingly, it is an object of the present invention to provide a burner for supplying a coal-water mixture and combustion air to a furnace which is uniquely designed to be capable of adjustment to handle a wide range of coal-water mixtures.

Additionally, it is an object of the present invention to provide such a coal-water slurry burner which is capable of operating with a high turndown.

SUMMARY OF THE INVENTION

The burner of the present invention comprises a slurry gun with atomizer disposed coaxially within a refractory-lined, divergent throat which is mountable in an opening in the wall of the furnace associated with the burner. First conduit means are disposed coaxially about the slurry gun in spaced relationship therewith between the slurry gun and the burner throat so as to divide the annular region therebetween into a primary air conduit surrounding the slurry supply gun and a auxiliary air conduit in the annular space between the burner throat and the first conduit means. Preferably, a swirler is disposed about the slurry gun so as to impart a swirl to the primary air passing through the first conduit means in order to stabilize the burner flame. Additionally, a second conduit means is disposed in spaced relationship between the burner throat and the first conduit means so as to divide the annular auxiliary air passage into a secondary air flow passage between the first and second conduit means and a separate tertiary air passage between the second conduit means and the burner throat.

In accordance with the present invention, a conically flared diffuser cone is slidably mounted about the first conduit means so as to be retractable within the secondary air passage from a position adjacent the burner outlet to a fully retracted position within the burner housing at a location remote from the burner outlet. Additionally, an annular sleeve is slidably mounted to the second conduit means so as to be retractable from a position adjacent the burner outlet to a second position within the burner housing remote from the burner outlet. Further, independently adjustable damper means are positioned in the inlet of each of the primary, secondary and tertiary air flow passages so as to independently control the pressure drop experienced by the air flowing through each of these passages.

By selectively positioning the diffuser cone at the outlet of the burner, combustion stability can be increased at low loads by the deflection of the secondary air outwardly as it passes from the secondary air flow passage around the diffuser cone and through the burner throat into the furnace. A recirculation pattern is established by the secondary air flowing around the diffuser cone which leads to flame stabilization at low loads. At high loads, the diffuser cone will be retracted fully within the housing so that the secondary air can enter the furnace in an axial direction to provide a difussion-type flame rather than being deflected outward to form the strong recirculation zone.

Further, with the diffuser cone positioned at the outlet of the burner, the area of the secondary air flow passage may be adjusted as to control air flow by selectively positioning the annular sleeve surrounding the secondary air conduit with respect to the diffuser cone. As the annular sleeve is slid along the second conduit means towards the diffuser cone, the secondary air flow passage area is decreased. Conversely, as the annular sleeve is retracted away from the diffuser cone, the secondary air flow passage is increased.

BRIEF DESCRIPTION OF THE DRAWINGS

Other objects and advantages of the invention will become apparent and the invention will be better understood from the following description when read in conjunction with the accompanying drawings wherein.

DESCRIPTION OF THE PREFERRED EMBODIMENT

Figure 1:
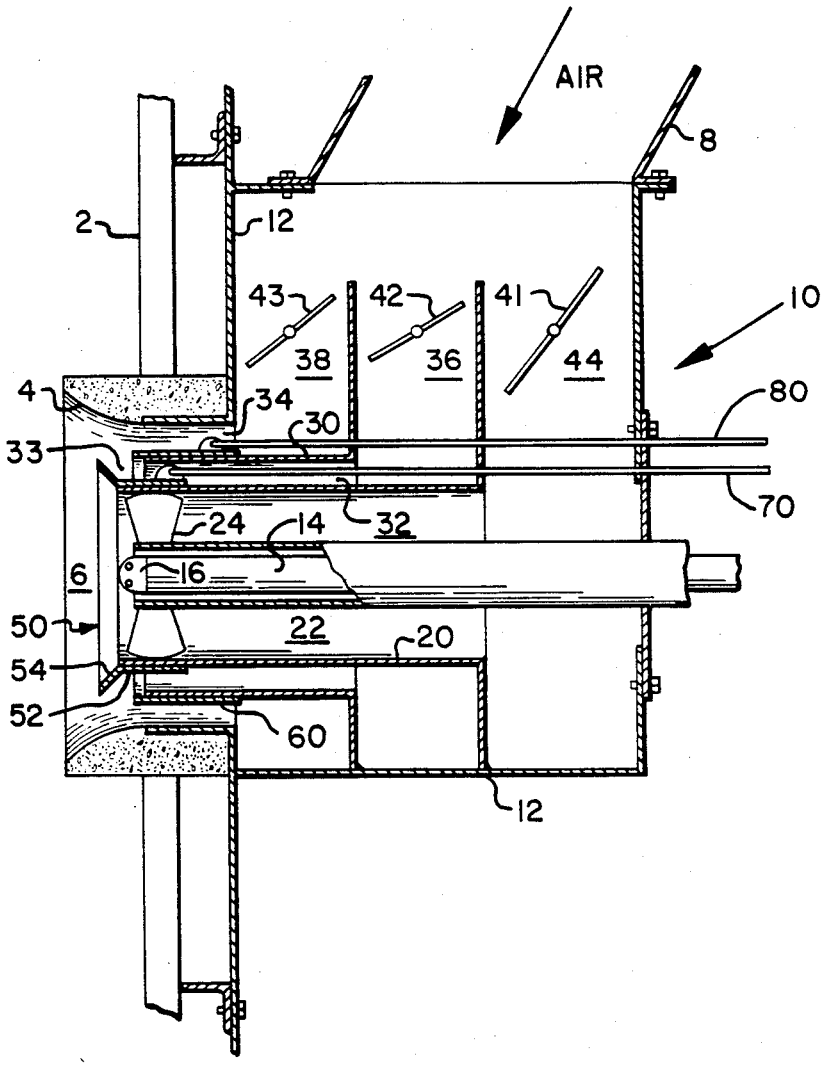
FIG. 1 is a side elevational view of the burner of the present invention with the diffuser cone positioned at the outlet of the burner and the annular sleeve retracted so as to provide a maximum area for secondary air flow.

Referring now to the drawing, there is depicted therein a burner 10 for burning a slurry fuel such as pulverized coal mixed in water. The burner 10 is shown mounted to a furnace wall 2 in the typical well-known manner. The refractory-lined burner throat 4 is inserted through the wall of the furnace 2 and defines a throat opening 6 through which the coal slurry and streams of supporting combustion air pass into the furnace.

As depicted in the drawings, the burner 10 comprises a housing 12 mounted to the burner throat 4 so as to surround the throat opening 6 in the burner throat 4 and extend therefrom away from the furnace 2 along a longitudinal axis. The end of the housing 12 surrounding the throat 4 opens directly into the furnace through the throat opening 6, while the opposite end of the housing 12 is closed. A combustion air supply duct 8 opens into the side wall of the housing 12 to provide combustion air to the interior of the housing 12. A coal slurry gun 14 is disposed within the burner housing 12 along the longitudinal axis thereof so as to extend coaxially through the housing. The end of the coal slurry gun 14 adjacent the furnace 2 is equipped with an atomizer tip 16 through which the coal slurry passing through the coal slurry gun 14 is sprayed into the furnace 2.

A first conduit means 20 is disposed coaxially about the coal slurry supply gun in spaced relationship therewith and intermediate the coal slurry supply gun and the throat means 4 so as to define a primary air flow passage 22 surrounding the coal slurry supply gun and opening into the furnace 2 through the throat opening 6 for directing a first stream of combustion air, termed primary air, into the furnace. A first inlet passage 44 opening into the primary air flow passage 22 is provided within the housing 12 for directing combustion air into the primary air flow passage 22 within the first conduit means 20 from the combustion air supply duct 8. Preferably, swirler means 24, shown as a spinner vane assembly, is disposed about the coal slurry supply pipe 14 within the first conduit means 20 so as to impart a swirling motion to the combustion air passing through the primary air flow passage 22 as a means of stabilizing the flame and increasing combustion efficiency.

Additionally, a second conduit means 30 is disposed coaxially about the first conduit means 20 in spaced relationship therewith intermediate between the first conduit means 20 and the burner throat means 4. The second conduit means 30 defines an annular secondary air flow passageway 32 between the first conduit means 20 and the second conduit means 30 and also defines an annular tertiary air flow passage 34 between the burner throat means 4 and the second conduit means 30. The annular secondary air flow passage 32 opens to the furnace 2 through the burner throat opening 6 in an annular circumferential ring about the primary air flow passage 22. A second air inlet 36 is provided within the housing 12 to open directly into the secondary air passage 32 for passing a flow of secondary air from the air supply duct 8 directly into the furnace 2 through the secondary air flow passage 32. The tertiary air flow passage 34 opens into the furnace 2 through the burner throat opening 6 in a second an annular circumferential ring disposed about the secondary air flow passage 32. A third air inlet passage 38 is provided within the housing 12 communicating with the tertiary air flow passage 34 for directing combustion air from the air supply duct 8 directly to the furnace 2 through the tertiary air flow passage 34.

First damper means 41, second damper means 42 and third damper means 43 are disposed respectively in the first air inlet 44 to the primary air flow passage 22, the second air inlet 36 to the secondary air passage 32, and the third air inlet 38 to the tertiary air passage 34 for controlling the gas pressure drop through the air inlets. Each of the first, second and third damper means is selectively positionable within its associated air inlet for independently controlling the gas pressure drop therethrough in accordance with the present invention. By independently positioning each of the damper means 41, 42 and 43 within the air inlets 44, 36 and 38, the combustion air passing into the burner housing through the supply duct 8 will experience an independently selected pressure drop in passing through each of the independent air inlets 44, 36 and 38. In this manner, the operator of the burner can vary the pressure differential in any of the three air streams independent of the others so as to independently control the velocity of each of the primary, secondary and tertiary air streams in response to load changes or to variations in the combustion characteristics of the coal slurry being burned.

Figure 2:
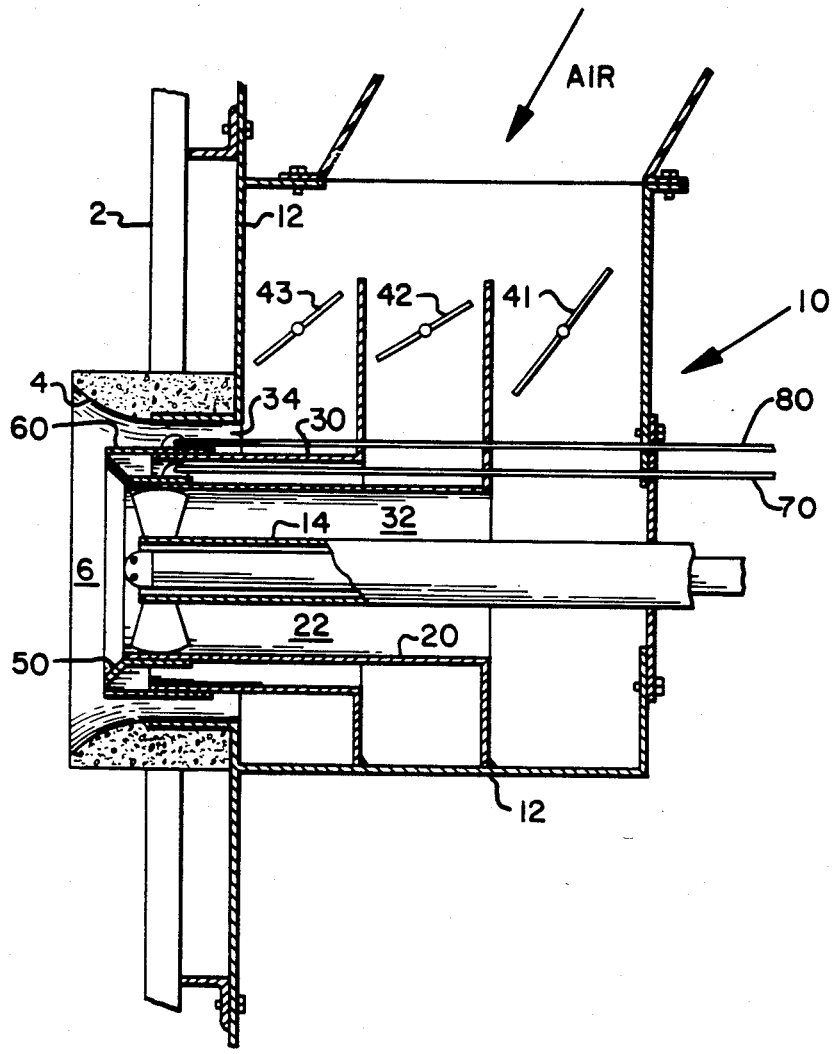
FIG. 2 is a sectional side elevational view of the burner of the present invention with the position of the diffuser cone and the annular sleeve adjusted so as to effectively close off the secondary air flow passage.
Figure 3:
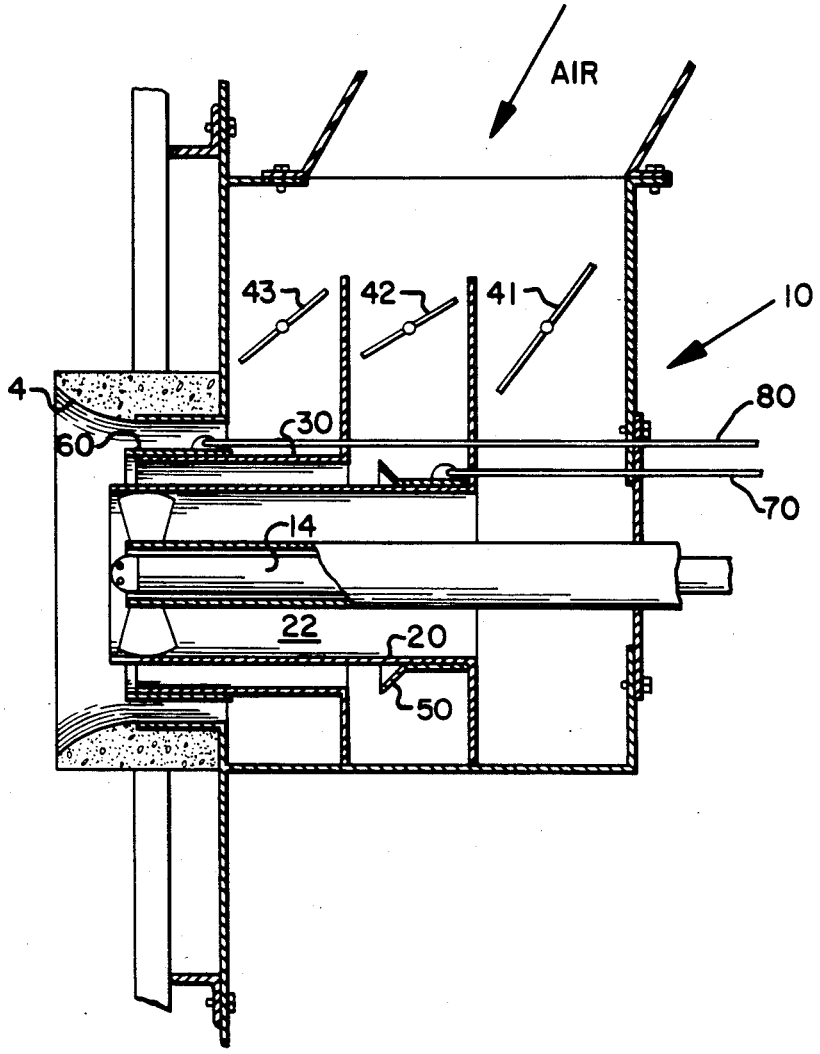
FIG. 3 is a sectional side elevational view of the burner of the present invention with the diffuser cone fully retracted within the burner housing.

Further in accordance with the present invention, diffuser means 50 is disposed about the first conduit means 20 and is slidably translatable therealong in an axial direction by means of positioning means 70 from a first position adjacent the furnace 2 within throat opening 6 as shown in FIGS. 1 and 2 to a position remote from the furnace 2 at the opposite ends of the burner housing 12 as shown in FIG. 3. Preferably, the diffuser means 50 comprises a support sleeve 52 disposed about and slidably translatable along the first conduit means 20 and an annular truncated cone-like ring 54 mounted to the end of the support sleeve 52 adjacent the furnace and extending outwardly therefrom towards the furnace into the burner throat opening 6. The diffuser means serves to deflect the secondary air radially outward through the divergent opening 6 defined by the throat means 4 whereby a strong recirculation pattern is established in the furnace downstream of the diffuser 50 thereby providing stability to the flame both aerodynamically and thermally.

Further in accordance with the present invention, an air flow adjustment sleeve 60 is disposed adjacent the second conduit means 30 and is slidably translatable therealong in an axial direction by means of positioning means 80. The air flow adjustment sleeve 60 is selectively adjustable with respect to the diffuser means 50 so as to cooperate together to close the flow area 33 of the opening of the secondary air flow passage 32 to the furnace 2. By translating the annular air flow adjustment sleeve 60 along the second conduit means 30 in a direction away from the diffuser 50, the flow area 33 at the outlet of the secondary air flow passage 32 between the diffuser 50 and the air flow adjustment sleeve 60 is increased. Conversely, by translating the annular air flow adjustment sleeve 60 along the second conduit means 30 in a direction toward the diffuser 50, the flow area 33 at the outlet of the secondary air flow passage 32 between the diffuser 50 and the air flow adjustment sleeve 60 can be decreased. As best seen in FIG. 2, by positioning the annular air flow adjustment sleeve in a fully forward position so as to contact or nearly contact the diffuser 50, the flow area 33 at the outlet of the secondary air flow passage 32 is closed or nearly closed off so as to preclude all but leakage air flow through the secondary air flow passage.

A burner design in accordance with the present invention provides the operator with a multiplicity of adjustments which can be made to control the flow of combustion air so as to provide good turndown capability in response to load changes and also so as to permit optimization of combustion efficiency for a wide variety of coal slurry composition. By selectively adjusting the damper means 41, 42 and 43 in conjunction with controlling the flow area 33 at the outlet of the secondary air flow passage 32, the operator may control the distribution of the combustion air amongst the primary, secondary and tertiary air streams for simultaneously controlling the velocity of these air streams. Additionally, the ability to respond to change in load is greatly enhanced by providing the translatable diffuser 50 which may be fully retracted within the burner housing 12 for operation at full load or may be fully extended into the burner throat opening 6 at lower loads to increase mass recirculation and provide flow stabilization at low loads.

I claim:

1. A burner for supplying coal in a liquid slurry and combustion air to a furnace through an opening in the wall of the furnace, comprising:

a. throat means mountable in the opening in the furnace wall for defining a passageway opening into the furnace;

b. a fuel supply gun disposed coaxially within the throat means along a longitudinal axis for injecting the coal-liquid slurry into the furnace;

c. first conduit means disposed coaxially about the fuel supply gun in spaced relationship with and between the fuel supply gun and the throat means, the first conduit means defining therein a primary air flow passage surrounding the fuel supply gun and opening into the furnace for directing a stream of primary air into the furnace;

d. second conduit means disposed coaxially about the first conduit means in spaced relationship with and between the first conduit means and the throat means, the second conduit means defining an annular secondary air flow passage between the first and second conduit means openings into the furnace for directing a stream of secondary air into the furnace and defining an annular tertiary air flow passage between the throat means and the second conduit means opening into the furnace for directing a stream of tertiary air into the furnace;

e. a burner housing mounted to the throat means and extending outwardly therefrom away from the furnace along a longitudinal axis coaxially about the second conduit means in spaced relationship therewith, the burner housing having inlet means for supplying air selectively and independently to the primary air flow passage, the secondary air flow passage, and the tertiary air flow passage;

f. a diffuser disposed about the first conduit means in sliding relationship therewith so as to be axially translatable from a position adjacent the furnace to a position remote from the furnace, the diffuser means having an outwardly expanding conical flange which extends into the throat means passageway in a direction towards the furnace when the diffuser is positioned adjacent the furnace so as to deflect secondary air radially outward whereby a recirculation pattern is established in the furnace downstream of the diffuser;

g. first positioning means operatively associated with the diffuser for translating the diffuser axially along the first conduit means from a first position adjacent the furnace within the throat means to a second position position remote from the furnace within the burner housing;

h. an air flow adjustment sleeve disposed about the second conduit means in sliding relationship therewith so as to be axially translatable therealong; and i. second positioning means operatively associated with the air flow adjustment sleeve for translating the air flow adjustment sleeve axially along the second conduit means so as to controllably and selectively position the air flow adjustment sleeve relative to the diffuser so as to control the flow area of the opening of the secondary air flow passage to the furnace.

2. A burner as recited in claim 1 wherein the inlet means of the burner housing for supplying air selectively and independently to the primary, secondary and tertiary air flow passages, comprises:

a. a first inlet opening to the primary air flow passage for supplying primary air thereto;

b. a second inlet opening to the secondary air flow passage for supplying secondary air thereto;

c. a third inlet opening to the tertiary air flow passage for supplying tertiary air thereto;

d. first damper means disposed in the first inlet selectively positionable therein for independently controlling the gas pressure drop through the first inlet;

e. second damper means disposed in the second inlet selectively positionable therein for independently controlling the gas pressure drop through the second inlet; and f. third damper means disposed in the third inlet selectively positionable therein for independently controlling the gas pressure drop through the third inlet.

3. A burner as recited in claim 1 wherein the diffuser comprises:

a. a support sleeve disoosed about and slidably translatable along the first conduit means from a position adjacent the furnace to a position remote from the furnace, and b. an annular truncated cone-like ring mounted to the support sleeve at the end thereof adjacent the furnace and extending outwardly therefrom towards the furnace.

* * * * *